US012637833B2

(12) United States Patent
Otsu

(10) Patent No.: US 12,637,833 B2
(45) Date of Patent: May 26, 2026

(54) WORK MACHINE

(71) Applicant: YANMAR HOLDINGS CO., LTD., Osaka (JP)

(72) Inventor: Motoharu Otsu, Fukuoka (JP)

(73) Assignee: YANMAR HOLDINGS CO., LTD., Osaka (JP)

( * ) Notice: Subject to any disclaimer, the term of this patent is extended or adjusted under 35 U.S.C. 154(b) by 0 days.

(21) Appl. No.: 19/172,916

(22) Filed: Apr. 8, 2025

(65) Prior Publication Data

US 2025/0347086 A1 Nov. 13, 2025

(30) Foreign Application Priority Data

May 9, 2024 (JP) ..... 2024-076536

(51) Int. Cl.
*E02F 9/08* (2006.01)
*E02F 9/16* (2006.01)

(52) U.S. Cl.
CPC ..... *E02F 9/0858* (2013.01); *E02F 9/16* (2013.01)

(58) Field of Classification Search
CPC ..... E02F 9/0858; E02F 9/16
See application file for complete search history.

(56) References Cited

U.S. PATENT DOCUMENTS 5,364,049 A * 11/1994 Long ..... H01Q 3/04 343/714
8,781,685 B2 * 7/2014 McClure ..... B62D 5/046 701/41
2009/0079640 A1 * 3/2009 Gray ..... H01Q 1/3275 343/713
2012/0059554 A1 * 3/2012 Omelchenko ..... G05D 1/0274 701/50
2014/0133945 A1 * 5/2014 Nishimura ..... E02F 9/0833 414/687
2014/0252803 A1 * 9/2014 Matsumoto ..... G01S 19/35 296/190.01
2020/0318322 A1 * 10/2020 Yamada ..... E02F 9/0858
2021/0230835 A1 * 7/2021 Hoshino ..... E02F 9/264
2022/0205217 A1 * 6/2022 Yuri ..... B60R 11/00
2023/0178881 A1 * 6/2023 Lee ..... H01Q 1/362
2024/0117606 A1 * 4/2024 Okazaki ..... E02F 9/265
2025/0092637 A1 * 3/2025 Nishigori ..... B60Q 1/0035
2025/0101712 A1 * 3/2025 Nishigori ..... E05C 1/10

FOREIGN PATENT DOCUMENTS

JP 2008-38438 A 2/2008

* cited by examiner

*Primary Examiner* — Paul N Dickson
*Assistant Examiner* — Shams Dhanani
(74) *Attorney, Agent, or Firm* — Future IP LLC; Tomoko Nakajima

(57) ABSTRACT

A work machine includes a machine body, a first antenna and a second antenna, a first bracket, and a second bracket. The machine body includes an occupant unit capable of accommodating an occupant. The first antenna and the second antenna are disposed on the occupant unit to be separated from each other in a plan view. The first bracket is supported by the occupant unit and supports the first antenna. The second bracket is provided separately from the first bracket, is supported by the occupant unit, and supports the second antenna.

15 Claims, 14 Drawing Sheets

WORK MACHINE

This application claims priority under 35 U.S.C. § 119 to Japanese Patent Application No. 2024-076536, filed on May 9, 2024, which is incorporated by reference.

TECHNICAL FIELD

The present invention relates to a work machine including a machine body including an occupant unit.

BACKGROUND ART

As a related art, a work machine including a plurality of antennas (GPS receivers) that measure a machine body position is known (see, for example, Patent Document 1). The work machine according to the related art includes a cabin (cab) for forming a driver's cabin on one side of a front portion of a turning body, and a plurality of antennas are detachably disposed in an upper portion of the cabin.

In the related art, a cab guard is detachably attached to the upper portion of the cabin, and the plurality of antennas are attached to the cab guard. An antenna closer to a work implement (work device) is disposed at a position higher than an antenna farther from the work implement to prevent the antenna closer to the work implement from being influenced by the work implement and having a lower reception sensitivity.

PRIOR ART DOCUMENT

Patent Document

Patent Document 1: Japanese Unexamined Patent Publication No. 2008-38438

SUMMARY OF INVENTION

Technical Problem

In the work machine according to the related art, the plurality of antennas are attached using the cab guard that covers the entire upper portion of the cabin; thus, the large mounting structure for the antennas may hinder the work machine from being light in weight and small in size.

An object of the present invention is to provide a work machine having an improved antenna mounting structure.

Solution to Problem

A work machine according to an aspect of the present invention includes a machine body, a first antenna and a second antenna, a first bracket, and a second bracket. The machine body includes an occupant unit capable of accommodating an occupant. The first antenna and the second antenna are disposed on the occupant unit to be separated from each other in a plan view. The first bracket is supported by the occupant unit and supports the first antenna. The second bracket is provided separately from the first bracket, is supported by the occupant unit, and supports the second antenna.

Advantageous Effects of Invention

The present invention can provide a work machine having an improved antenna mounting structure.

DESCRIPTION OF EMBODIMENTS

Figure 1:
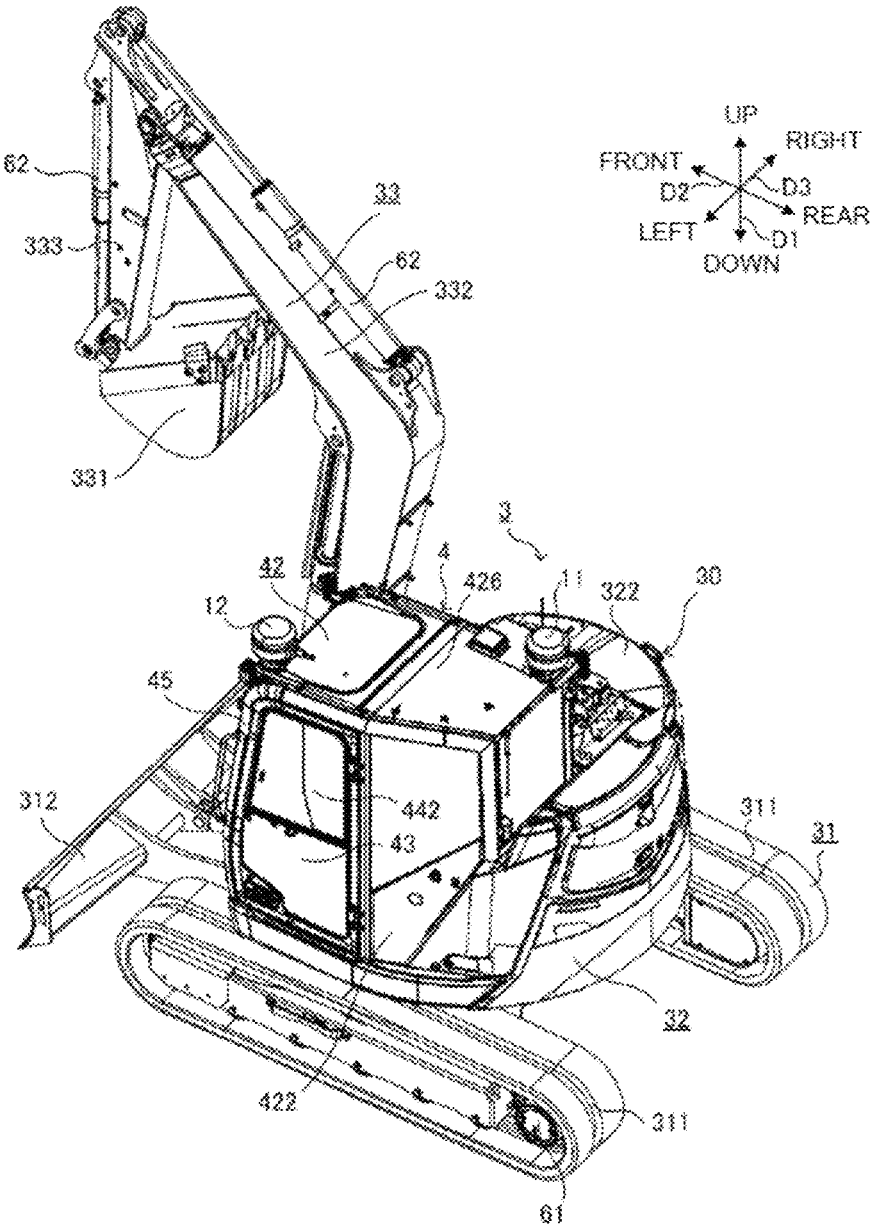
FIG. 1 is a schematic perspective view of a work machine according to Embodiment 1 as viewed from the left rear.

An embodiment of the present invention will be described below with reference to the accompanying drawings. The following embodiment is an example that embodies the present invention, and is not intended to limit the technical scope of the present invention.

Embodiment 1

[1] Overall Configuration

As illustrated in FIGS. 1 to 4, a work machine 3 according to the present embodiment includes a traveling unit 31, a turning unit 32, and a work implement 33. Furthermore, the work machine 3 includes an occupant unit 4 that is capable of accommodating an occupant. In the present embodiment, the traveling unit 31, the turning unit 32, the work implement 33, and the occupant unit 4 are included in a machine body 30 of the work machine 3.

Figure 6:
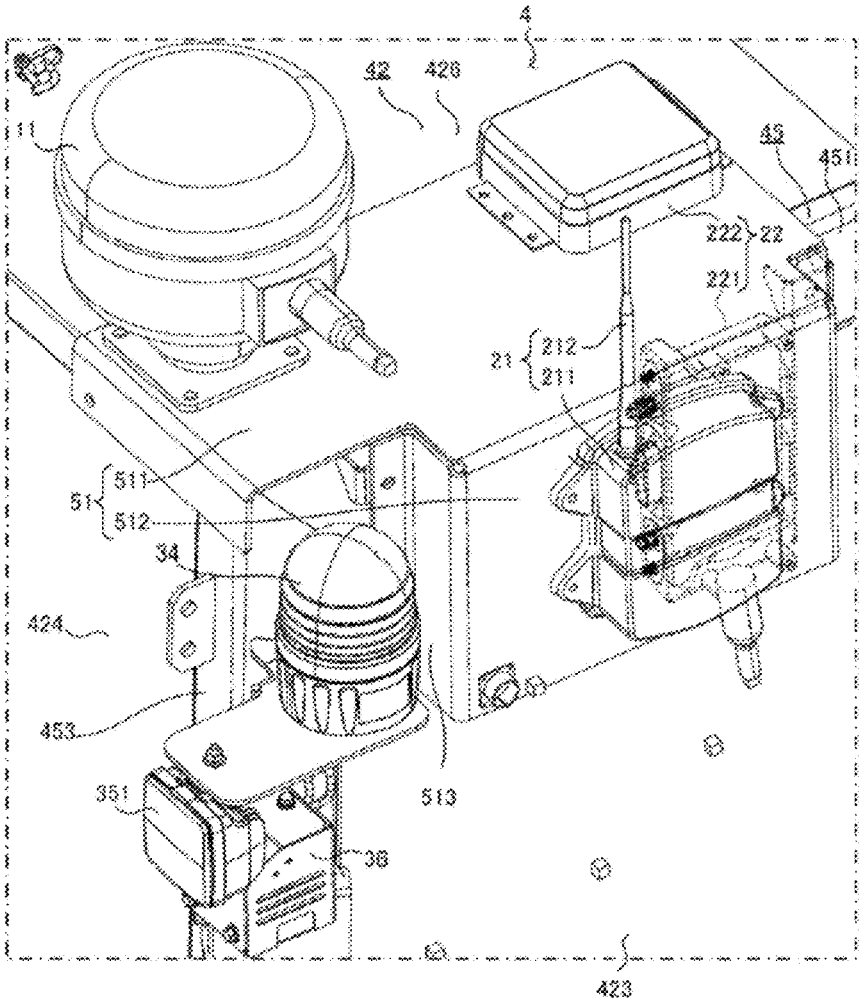
FIG. 6 is an enlarged view of a region Z1 in FIG. 5, and illustrates a main part of the occupant unit of the work machine according to Embodiment 1.

The work machine 3 according to the present embodiment further includes a first antenna 11, a second antenna 12, a first communication device 21 (see FIG. 2), and a second communication device 22 (see FIG. 6). The first antenna 11 and the second antenna 12 are antennas of a positioning device that detects the current position (latitude, longitude, altitude, and the like), current azimuth, and the like of the machine body 30. The first communication device 21 and the second communication device 22 are configured to be communicable with a device (server or the like) outside the machine body 30 by different communication methods. Electrical components (electric devices) such as the first antenna 11, the second antenna 12, the first communication device 21, and the second communication device 22 are mounted on the machine body 30 of the work machine 3.

Figure 4:
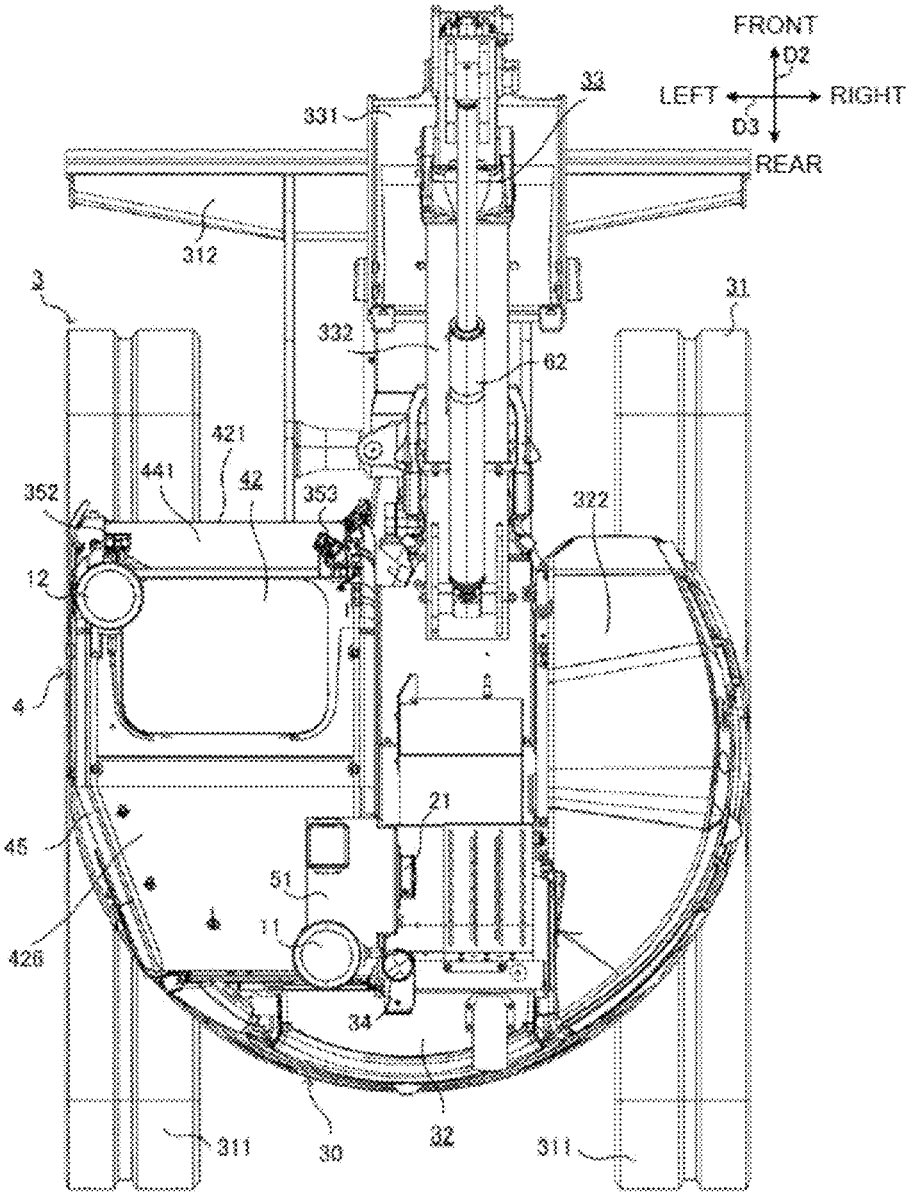
FIG. 4 is a schematic plan view of the work machine according to Embodiment 1.
Figure 5:
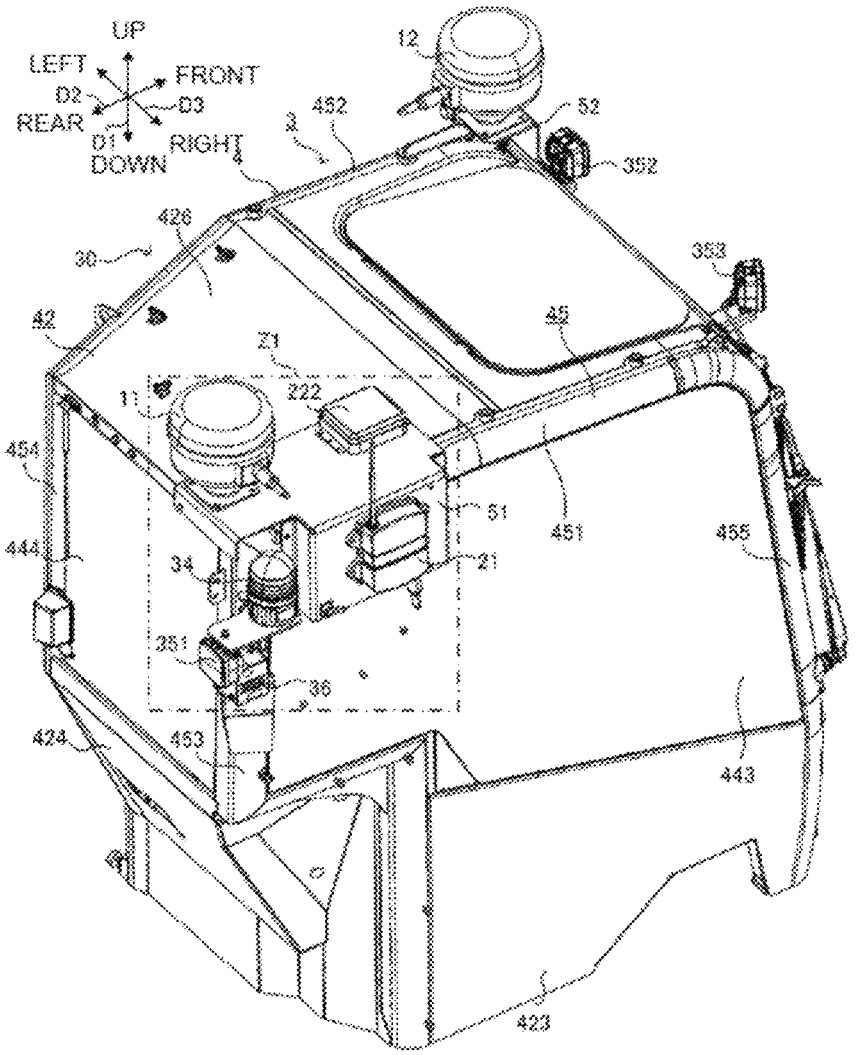
FIG. 5 is a schematic perspective view of an occupant unit of the work machine according to Embodiment 1 as viewed obliquely from above.

The work machine 3 further includes a first bracket 51 (see FIG. 4) and a second bracket 52 (see FIG. 5). The first bracket 51 is a member that supports at least the first antenna 11, and is attached to the machine body 30. The second bracket 52 is a member that supports at least the second antenna 12, and is attached to the machine body 30.

In addition, the work machine 3 further includes an indicator light 34 (see FIG. 2), lights 351, 352, and 353 (see FIG. 5), an alarm device 36 (see FIG. 2), a display device, an operation device, a control device, and various sensors (including a sonar, a camera, and the like), and the like.

The term "work machine" as used in the present disclosure refers to a machine for performing various types of work, and examples thereof include work vehicles such as a backhoe (including a hydraulic excavator, a mini excavator, and the like), a wheel loader, and a carrier. The work machine 3 includes the work implement 33 that is configured to be able to perform one or more types of work. The work machine 3 is not limited to a "vehicle", and may be, for example, a work ship, a work flying object such as a drone or a multicopter, or the like. Furthermore, the work machine 3 is not limited to a construction machine (construction equipment), and may be, for example, an agricultural machine (agricultural equipment) such as a rice transplanter, a tractor, or a combine harvester. In the present embodiment, unless otherwise specified, an example will be described in which the work machine 3 is a riding type backhoe and is capable of performing work such as excavation work, ground leveling work, trench excavation work, or loading work. More specifically, in the work machine 3 according to the present embodiment, the turning unit 32 including the work implement 33 is assumed to be of an "ultra-small turning type" that can fully turn within 120% of the entire width of the traveling unit 31 (the entire width of a pair of left and right crawlers 311) or a "rear ultra-small turning type" with a rear turning radius ratio of 120% or less.

In the present embodiment, as an example, an occupant who gets in the occupant unit 4 is an operator (manipulator), and the work machine 3 is moved by an operation performed by the occupant. However, the occupant is not limited to an operator, and for example, when the work machine 3 is moved by remote control or automatic driving, the occupant may be a person who gets on the work machine 3 for the purpose of monitoring, inspection (maintenance), or the like. Furthermore, the occupant unit 4 may be able to simultaneously accommodate a plurality of occupants, and in such a case, a single occupant unit 4 may include a plurality of occupant seats.

In the present embodiment, for convenience of description, an up-down direction D1 is defined as the vertical direction while the work machine 3 is in a usable state. Furthermore, a front-rear direction D2 and a left-right direction D3 are defined with respect to the direction as viewed from an occupant (operator) who gets in the occupant unit 4 of the work machine 3. In other words, each of the directions used in the present embodiment is a direction defined with respect to the occupant unit 4 of the work machine 3. The "front side" is a direction toward which the machine body 30 moves when the work machine 3 moves forward, and the "rear side" is a direction toward which the machine body 30 moves when the work machine 3 moves rearward. Similarly, the "right side" is a direction toward which a front end portion of the machine body 30 moves when the work machine 3 turns right, and the "left side" is a direction toward which the front end portion of the machine body 30 moves when the work machine 3 turns left. The occupant unit 4 is provided on the turning unit 32; thus, when the turning unit 32 turns, the front-rear direction D2 and the left-right direction D3 for the traveling unit 31 change. In the following description, as illustrated in FIG. 1, the directions are defined as directions while the front of the occupant unit 4 faces the direction of travel of the traveling unit 31. However, these directions are not intended to limit use directions (directions during use) of the work machine 3.

The work machine 3 includes an engine that serves as a power source. In the present embodiment, as an example, the engine is a diesel engine. The engine is driven by fuel (light oil in this case) supplied from a fuel tank. In the work machine 3, for example, a hydraulic pump is driven by the engine, and hydraulic oil is supplied from the hydraulic pump to hydraulic actuators (including a hydraulic motor 61, a hydraulic cylinder 62, and the like) of the components of the machine body 30 to drive the machine body 30. For example, a user (operator) who gets in the occupant unit 4 of the machine body 30 operates the operation device to control the work machine 3.

In the present embodiment, as described above, the work machine 3 is assumed to be a riding type backhoe; thus, the work implement 33 is driven and performs work such as excavation work according to an operation performed by an occupant (operator) who gets in the occupant unit 4. The work implement 33 is supported by the turning unit 32 provided with the occupant unit 4. Thus, when the turning unit 32 turns, the work implement 33 turns together with the occupant unit 4.

The occupant unit 4 of the machine body 30 includes the display device, the operation device, and the like, and an occupant can operate the operation device while viewing various types of information related to the work machine 3 displayed on the display device. For example, when information on an operating state of the work machine 3 such as a cooling water temperature and a hydraulic oil temperature is displayed on a display screen of the display device, an occupant can check, on the display device, information on the operating state of the work machine 3 required to operate the operation device.

The traveling unit 31 has a traveling function, and is configured to be able to travel (and turn) on the ground. The traveling unit 31 includes, for example, the pair of left and right crawlers 311, a blade 312, and the like. The traveling unit 31 further includes the hydraulic motor 61 (hydraulic actuator) for traveling that drives the crawlers 311, and the like.

The turning unit 32 is disposed above the traveling unit 31, and can turn with respect to the traveling unit 31 in a plan view. That is, the turning unit 32 is located above the traveling unit 31, and is configured to be able to turn with respect to the traveling unit 31 around a rotation axis extending in the vertical direction. The turning unit 32 includes a hydraulic motor as a hydraulic actuator for turning, and the like. The turning unit 32 includes the engine, the hydraulic pump, and the like, in addition to the occupant unit 4. Furthermore, the turning unit 32 is provided with a boom bracket as a fulcrum portion 321 (see FIG. 2) to which the work implement 33 is attached. The turning unit 32 has a substantially circular shape in a plan view in which a front end portion is cut into a flat shape. The turning unit 32 can turn around a center of the circular shape as a rotation axis.

The work implement 33 is supported by the turning unit 32, and is configured to be able to perform one or more types of work. The work implement 33 is supported by the fulcrum portion 321 (boom bracket) of the turning unit 32 and performs work. The work implement 33 includes a bucket 331. The bucket 331 is a type of attachment (work tool) attached to the machine body 30 of the work machine 3, and is composed of an arbitrary tool selected from a plurality of types of attachments according to the work content. For example, the bucket 331 is detachably attached to the machine body 30, and is replaced according to the work content. In addition to the bucket 331, examples of (end) attachments for the work machine 3 include various tools such as a breaker, an auger, a crusher, a fork, a fork claw, a steel frame cutter, an asphalt cutting machine, a mower, a ripper, a mulcher, a tilt rotator, and a tamper.

The work implement 33 further includes a boom 332, an arm 333, a hydraulic actuator (including the hydraulic cylinder 62, the hydraulic motor, and the like), and the like. The bucket 331 is attached to a tip of the arm 333. The bucket 331 is supported by the arm 333 to be rotatable around a rotation axis extending in the horizontal direction.

The boom 332 is rotatably supported by the fulcrum portion 321 of the turning unit 32. Specifically, the boom 332 is supported by the fulcrum portion 321 to be rotatable around a rotation axis extending in the horizontal direction. The boom 332 has a shape extending upward from a base end portion supported by the fulcrum portion 321. The arm 333 is coupled to a tip of the boom 332. The arm 333 is supported by the boom 332 to be rotatable around a rotation axis extending in the horizontal direction.

The work implement 33 is moved by power received from the engine as a power source. Specifically, the hydraulic pump is driven by the engine, and hydraulic oil is supplied from the hydraulic pump to the hydraulic actuators (the hydraulic cylinder 62 and the like) of the work implement 33 to move the components (the bucket 331, the boom 332, and the arm 333) of the work implement 33.

In the present embodiment, in particular, the work implement 33 has an articulated structure in which the boom 332 and the arm 333 are configured to be individually rotatable. That is, each of the boom 332 and the arm 333 is rotated around the rotation axis extending in the horizontal direction, for example, to allow the articulated work implement 33 including the boom 332 and the arm 333 as a whole to be extended or retracted. Furthermore, the bucket 331 as an attachment is supported by the machine body 30 (turning unit 32) via the boom 332 and the arm 333, and the bucket 331 is rotated with respect to the arm 333 to be opened and closed.

As with the work implement 33, each of the traveling unit 31 and the turning unit 32 is moved by power received from the engine as a power source. That is, hydraulic oil is supplied from the hydraulic pump to the hydraulic motor 61 of the traveling unit 31, the hydraulic motor of the turning unit 32, and the like to move the turning unit 32 and the traveling unit 31.

The work machine 3 further includes a drive device (mechanism) such as power take-off (PTO) for supplying power to the bucket 331 (attachment). Specifically, the drive device sends, to the bucket 331, hydraulic oil from the hydraulic pump driven by the engine, and adjusts the flow rate of hydraulic oil to adjust the amount of power supplied to the bucket 331.

The occupant unit 4 is a space for accommodating an occupant, and is located on the turning unit 32 in the present embodiment. Thus, in plan view, when the turning unit 32 turns, the occupant unit 4 also turns. Specifically, the occupant unit 4 is provided in a left side portion of the turning unit 32 divided into two portions in the left-right direction D3. The occupant unit 4 includes at least an occupant seat on which an occupant is seated.

Types of the occupant unit 4 of the work machine 3 such as a construction machine include a cabin type, a canopy type, a floor type, and the like. A cabin type occupant unit 4 includes a cabin 42, and an occupant gets into a cabin space inside the cabin 42. A canopy type occupant unit 4 includes a canopy (roof), and an occupant gets into a space below the canopy. A floor type occupant unit 4 does not include the cabin 42, a canopy, or the like, and an occupant gets into a space opened upward. That is, the occupant unit 4 may include not only an aspect in which the occupant unit 4 is surrounded by panels or the like but also various aspects in which the occupant unit 4 is prepared as a space capable of accommodating an occupant. In the present embodiment, a case of the cabin type occupant unit 4 will be described as an example.

In the present embodiment, the occupant unit 4 is disposed in a left side portion of the machine body 30 of the work machine 3. Furthermore, the occupant unit 4 is located above the left crawler 311 (see FIG. 1). With such an arrangement, an occupant gets in and out of the occupant unit 4 from the left side of the occupant unit 4. Thus, in the present embodiment, a door 43 of the occupant unit 4 is disposed on the left side of the occupant unit 4 in the left-right direction D3. That is, an occupant gets in and out of the occupant unit 4 through the door 43 disposed on the left side of the occupant unit 4.

The cabin type occupant unit 4 includes an occupant seat as a seat on which an occupant is seated, and the cabin 42 shaped to cover the occupant seat. The cabin 42 includes a (cabin) frame 45, a cabin roof 426, and the like. In other words, the cabin 42 constitutes a contour of the occupant unit 4, and an occupant gets in (inside) the cabin 42.

The frame 45 is a structure as a framework of the cabin 42, and surrounds the cabin space. The cabin roof 426 is disposed above the frame 45, and is supported by the frame 45. The cabin roof 426 has a substantially rectangular shape in plan view, and has a size that covers the entire occupant unit 4.

The cabin 42 includes a front panel 421, a left side panel 422, a right side panel 423, and a rear panel 424. The front panel 421 constitutes a front surface of the cabin 42, the left side panel 422 constitutes a left side surface of the cabin 42, the right side panel 423 constitutes a right side surface of the cabin 42, and the rear panel 424 constitutes a rear surface of the cabin 42.

The front panel 421 is provided with a windshield 441. Similarly, the left side panel 422 is provided with a left side glass 442, the right side panel 423 is provided with a right side glass 443, and the rear panel 424 is provided with a rear glass 444. The front panel 421, the left side panel 422, the right side panel 423, and the rear panel 424 are appropriately attached to both sides of the frame 45 in the front-rear direction D2 and both sides of the frame 45 in the left-right direction D3. The panels on four sides surround, together with the door 43, the cabin space.

The door 43 is provided in an opening portion provided on the left side of the cabin 42, and is rotatable between a "closed position" at which the opening portion is covered and an "open position" at which the opening portion is opened to allow an occupant to pass through. Types of the door 43 include a "front opening type" in which a front side portion of the door 43 in the front-rear direction D2 is opened and a "rear opening type" in which a rear side portion of the door 43 in the front-rear direction D2 is opened. In the present embodiment, as an example, the door 43 is of the front opening type. Furthermore, in the present embodiment, the door 43 is opened outward, and the door 43 is opened by an operation of pulling a front end portion as a free end of the door 43 toward the front side (outer side of the occupant unit 4) as viewed from the front (left side in the present embodiment) of the door 43 outside the occupant unit 4.

With the configuration described above, when an occupant gets in the occupant unit 4, the occupant gets into the cabin space inside the cabin 42 while the door 43 is opened (located at the open position), and closes the door 43 (causes the door 43 to be at the closed position) to get in the occupant unit 4. On the other hand, when an occupant gets off the occupant unit 4, the occupant gets out of the cabin 42 while the door 43 is opened (located at the open position), and closes the door 43 (causes the door 43 to be at the closed position) to get off the occupant unit 4. In particular, in the cabin type occupant unit 4 including the cabin 42 as in the present embodiment, at least the frame 45 has a function as a framework of the cabin 42, and has sufficient strength (rigidity) to support the cabin roof 426, the door 43, and the like. The cabin 42 may be detachable from the machine body 30 (turning unit 32) of the work machine 3.

Furthermore, exterior components such as various sensors and mirrors can be mounted on the cabin 42.

The positioning device of the work machine 3 according to the present embodiment detects the current position, current azimuth, and the like of the machine body 30 using a satellite positioning system such as a global navigation satellite system (GNSS). Identification of the current position, current azimuth, and the like of the machine body 30 enables, for example, management of a work status (progress and the like) of the work machine 3 including recording of a travel path of the work machine 3, automatic driving of the work machine 3, and the like. The automatic driving of the work machine 3 in this case includes "autonomous traveling" in which the work machine 3 travels autonomously without requiring an operation performed by an operator, and "semi-automatic traveling" in which only steering of the work machine 3 is automated, for example, as in straight travel assist. In the "semi-automatic traveling", the work machine 3 cannot travel without an operation performed by an operator; however, the "semi-automatic traveling" reduces the burden on the operator for steering, and allows the work machine 3 to travel along a target route such as a straight route, leading to higher work efficiency.

The first antenna 11 and the second antenna 12 constituting the antennas of the positioning device receive a GNSS signal (satellite signal) from a positioning satellite of the satellite positioning system such as a GNSS. That is, the first antenna 11 and the second antenna 12 are position identifying antennas for identifying the position of the machine body 30, and the positioning device performs a positioning process of identifying (calculating) the current position, current azimuth, and the like of the machine body 30 using a GNSS signal transmitted from the satellite.

The first antenna 11 and the second antenna 12 are disposed on an upper surface (top surface) of the machine body 30 to easily receive a signal (GNSS signal) from the satellite. The first antenna 11 and the second antenna 12 are disposed to be separated from each other in plan view. Thus, the positioning device can receive a GNSS signal or the like by each of the two antennas (the first antenna 11 and the second antenna 12).

The current position of the work machine 3 may be identified from the position of one of the first antenna 11 and the second antenna 12, or may be identified from the positions of both the first antenna 11 and the second antenna 12. Thus, for example, even when one of the first antenna 11 and the second antenna 12 cannot receive a GNSS signal or the like, the other of the first antenna 11 and the second antenna 12 can receive a GNSS signal or the like and identify the current position, current azimuth, and the like of the machine body 30. Furthermore, the first antenna 11 and the second antenna 12 can identify the current position at the respective positions separated from each other in plan view, and thus can also identify the orientation (current azimuth) of the machine body 30.

The first communication device 21 and the second communication device 22 are each configured to be communicable with a server device that distributes correction data. The term "communicable" as used in the present disclosure refers to being able to transmit and receive information directly or indirectly through a communication network (network), a relay, or the like by an appropriate communication method such as wired communication or wireless communication (communication using a radio wave or light as a medium). For example, the first communication device 21 and the second communication device 22 are communicable with the server device through a communication network such as the Internet, a local area network (LAN), a wide area network (WAN), a public telephone line, a mobile phone line network, a packet network, or a wireless LAN. The correction data is data for correcting the current position, current azimuth, and the like identified from a GNSS signal or the like received by the first antenna 11 and the second antenna 12, and is distributed from the server device as needed.

In the present embodiment, as an example, the first communication device 21 is a communication device (communication terminal) that performs mobile communication that is wireless communication via a mobile phone line. The second communication device 22 is a communication device (communication terminal) that performs wireless communication in accordance with Wi-Fi (registered trademark). That is, both the first communication device 21 and the second communication device 22 communicate with the server device through wireless communication using a radio wave as a communication medium, by different communication methods.

With the configuration described above, the positioning device employs a positioning method with relatively high accuracy such as real time kinematic (RTK) positioning in which positioning is performed based on positioning information (GNSS signal or the like) received by the first antenna 11 and the second antenna 12 and correction data (correction information) received by the first communication device 21 and the second communication device 22. Thus, the work machine 3 according to the present embodiment can identify the current position, current azimuth, and the like of the machine body 30 with relatively high accuracy, for example, leading to management of the work status of the work machine 3, automatic driving of the work machine 3, and the like with higher efficiency.

The indicator light 34 is turned on (emits light) according to a movement state of the work machine 3. The indicator light 34 is disposed outside the cabin 42, and provides an indication mainly to a person who is present around the work machine 3. In the present embodiment, in particular, the indicator light 34 is configured to be able to emit light of a plurality of colors (e.g., three colors), and emits light of a different color according to the movement state of the work machine 3.

The indicator light 34 is turned on (emits light) according to a movement state of the work machine 3. The indicator light 34 is disposed outside the cabin 42, and provides an indication mainly to a person who is present around the work machine 3. In the present embodiment, in particular, the indicator light 34 is configured to be able to emit light of a plurality of colors (e.g., three colors), and emits light of a different color according to the movement state of the work machine 3.

The lights 351, 352, and 353 output light (e.g., white light) from the machine body 30 toward the outside, and function as work lamps that illuminate an area around the machine body 30. The lights 351, 352, and 353 illuminate a work target for which work is performed by the work machine 3 to allow the work target to be visually observed, for example, even in a dark environment such as nighttime.

The alarm device 36 has a function of outputting an alarm sound. The alarm device 36 is disposed outside the cabin 42, and issues an alarm mainly to a person who is present around the work machine 3. The alarm device 36 includes at least one of a sound output unit that issues an alarm using the sound of an alarm buzzer or the like and an optical output unit that issues an alarm using the optical output of an alarm lamp or the like. Thus, the alarm device 36 can issue an alarm to a person who is present around the work machine 3 in various environments such as a bright site during daytime or a site near a noisy place.

Figure 2:
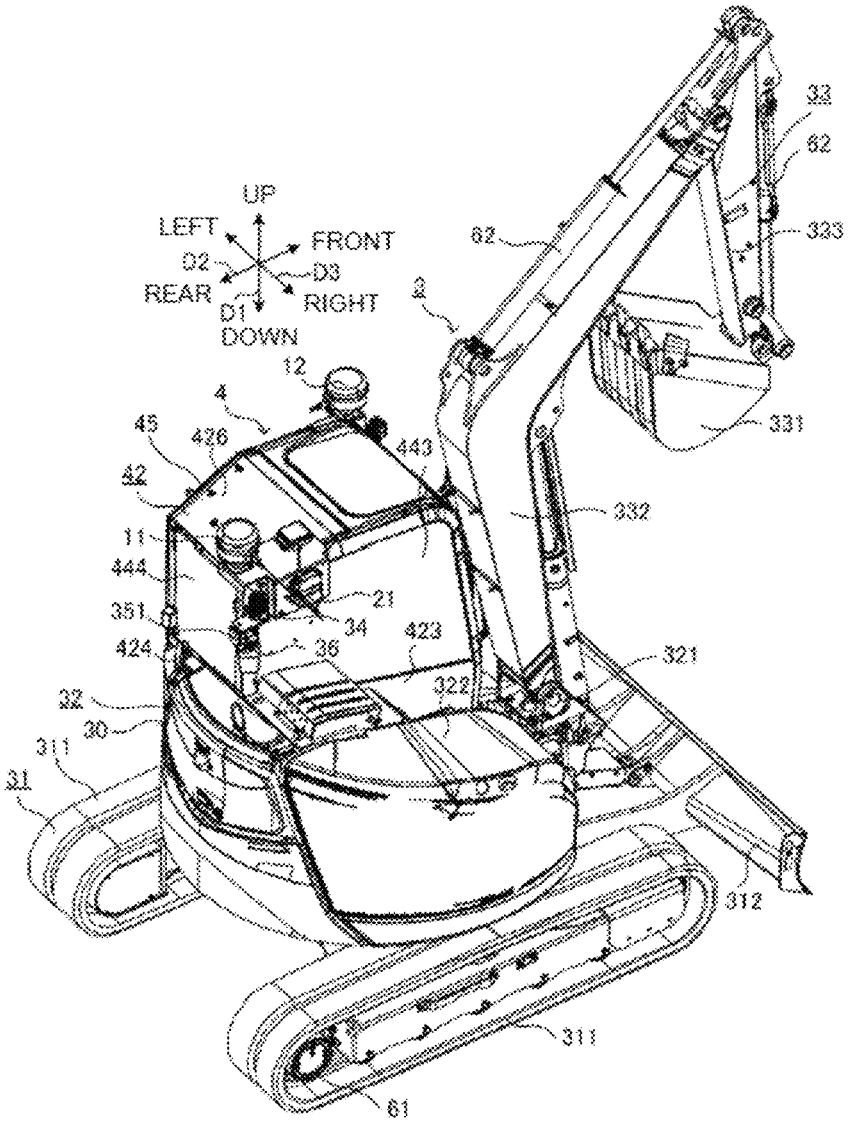
FIG. 2 is a schematic perspective view of the work machine according to Embodiment 1 as viewed from the right rear.
Figure 3:
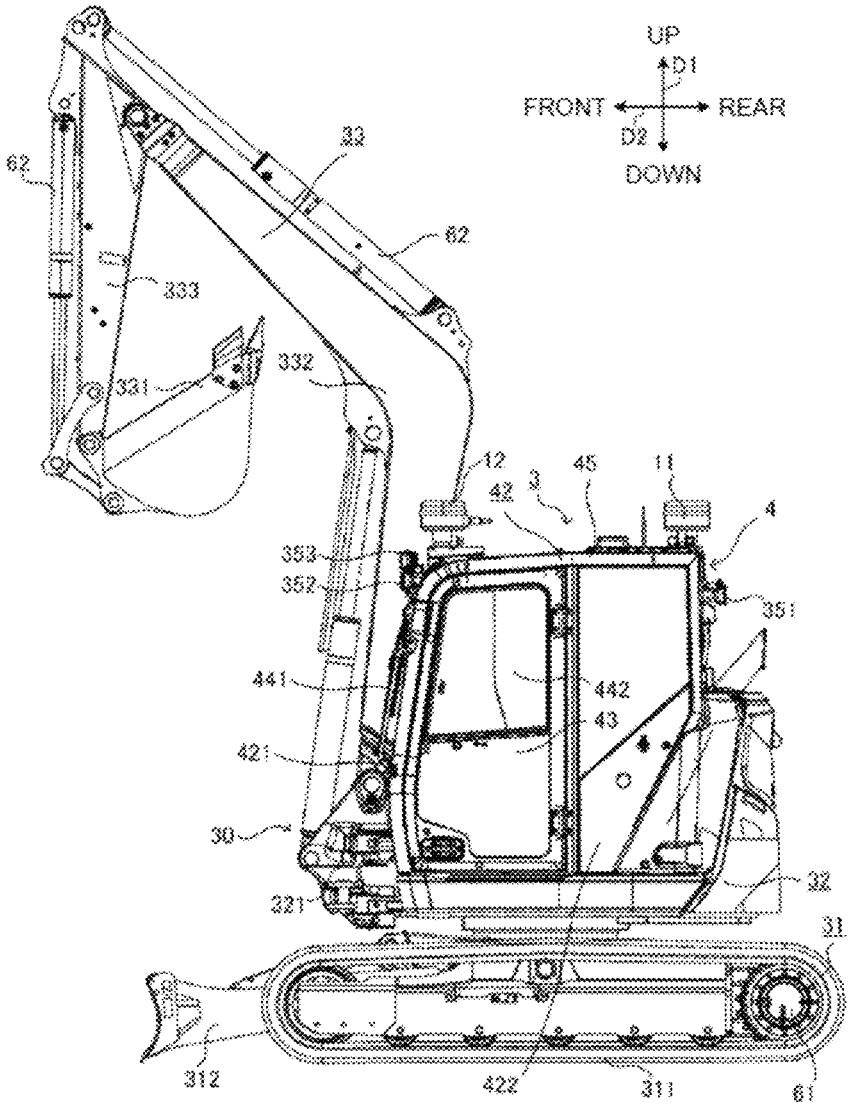
FIG. 3 is a schematic left side view of the work machine according to Embodiment 1.

The first antenna 11, the second antenna 12, the first communication device 21, the second communication device 22, the indicator light 34, the lights 351, 352, and 353, and the alarm device 36 are all disposed on the turning unit 32. In particular, as illustrated in FIGS. 2 to 4, the first antenna 11, the second antenna 12, the first communication device 21, the second communication device 22, the indicator light 34, the lights 351, 352, and 353, and the alarm device 36 are attached to an outer surface of the occupant unit 4 on the turning unit 32. The arrangement of the first antenna 11, the second antenna 12, the first communication device 21, the second communication device 22, the indicator light 34, the lights 351, 352, and 353, and the alarm device 36 will be described in detail in the section "[2] Arrangement of Electrical Components".

The control device is mainly composed of, for example, a computer system including one or more processors such as a central processing unit (CPU), and one or more memories such as a read only memory (ROM) and a random access memory (RAM), and executes various types of processing (information processing). In the present embodiment, the control device is an integrated controller that controls the entire work machine 3, and is composed of, for example, an electronic control unit (ECU). However, the control device may be provided separately from an integrated controller, and may be mainly composed of a single processor or a plurality of processors.

The work machine 3 further includes a cutoff lever (gate lock lever), a fuel tank, a hydraulic oil tank, a cooling water tank, a battery, and the like, in addition to the components described above. The cutoff lever is operable between an "up position" and a "down position", and when the cutoff lever is at the "up position", the movement of the work machine 3 is forcibly restricted without requiring an operation of the operation device.

[2] Arrangement of Electrical Components

Next, the arrangement of the electrical components such as the first antenna 11, the second antenna 12, the first communication device 21, the second communication device 22, the indicator light 34, the lights 351, 352, and 353, and the alarm device 36 of the work machine 3 according to the present embodiment will be described in detail with reference to FIGS. 5 to 14.

In the present embodiment, the first antenna 11, the second antenna 12, the first communication device 21, the second communication device 22, the indicator light 34, the lights 351, 352, and 353, the alarm device 36, and the like are all attached to the occupant unit 4. Specifically, the first antenna 11, the second antenna 12, the first communication device 21, the second communication device 22, the indicator light 34, the lights 351, 352, and 353, the alarm device 36, and the like are attached to the outer side of the cabin 42 of the occupant unit 4. Thus, the following description will focus on a portion of the work machine 3 around the occupant unit 4 (cabin 42).

Figure 7:
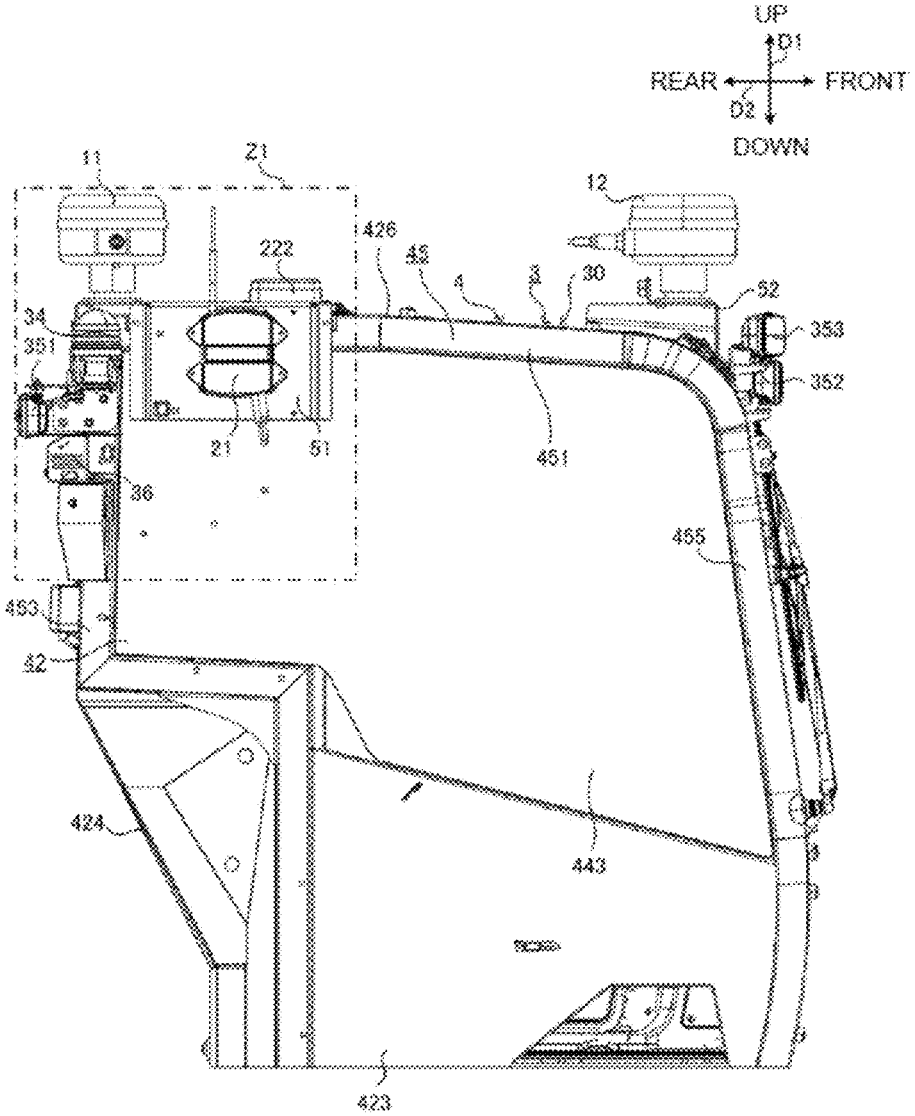
FIG. 7 is a schematic right side view of the occupant unit of the work machine according to Embodiment 1.
Figure 8:
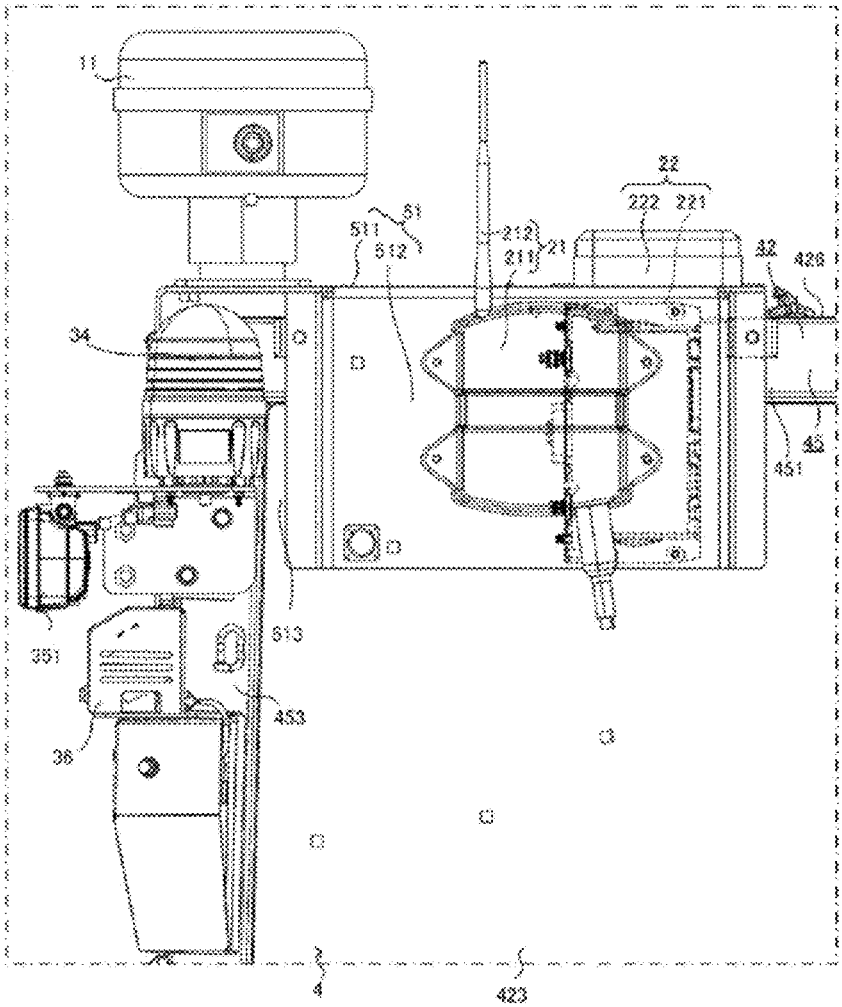
FIG. 8 is an enlarged view of the region Z1 in FIG. 7, and illustrates the main part of the occupant unit of the work machine according to Embodiment 1.
Figure 9:
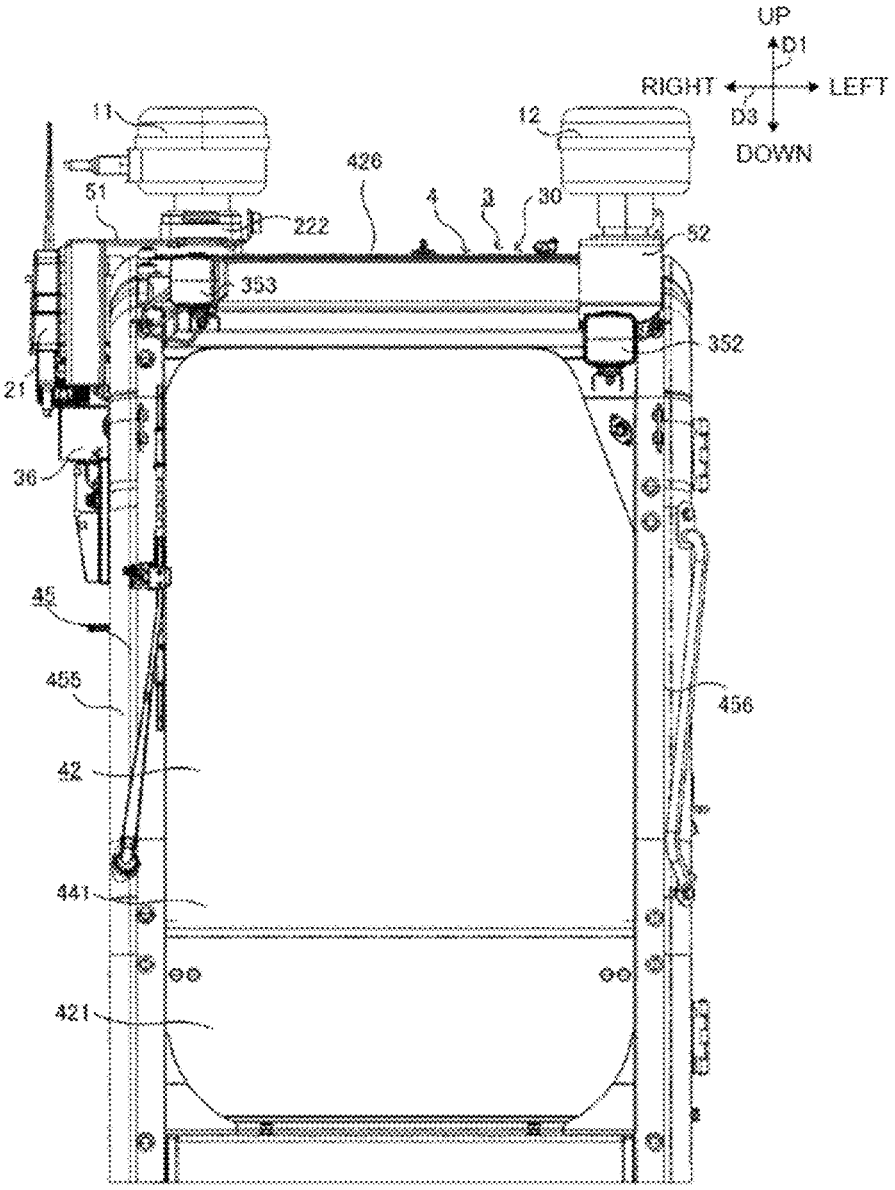
FIG. 9 is a schematic front view of the occupant unit of the work machine according to Embodiment 1.
Figure 10:
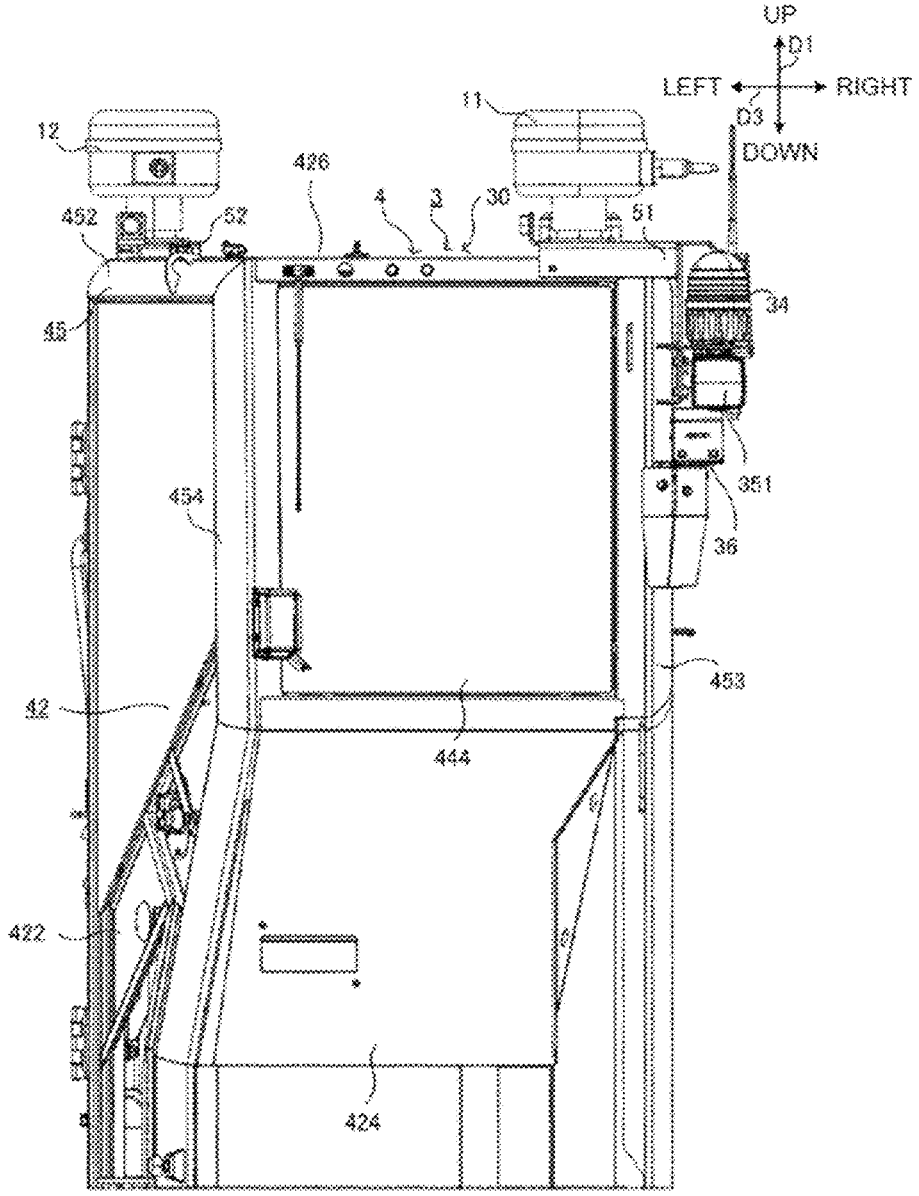
FIG. 10 is a schematic rear view of the occupant unit of the work machine according to Embodiment 1.
Figure 11:
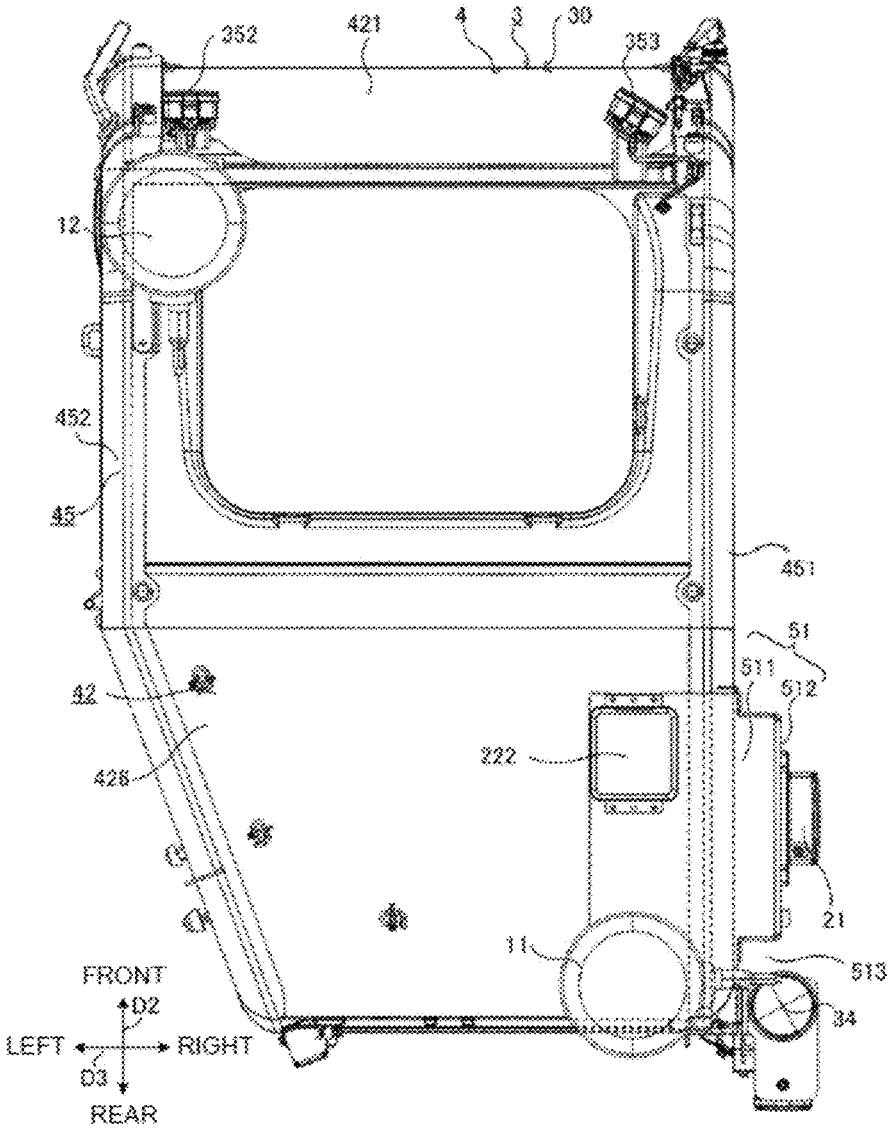
FIG. 11 is a schematic plan view of the occupant unit of the work machine according to Embodiment 1.
Figure 12:
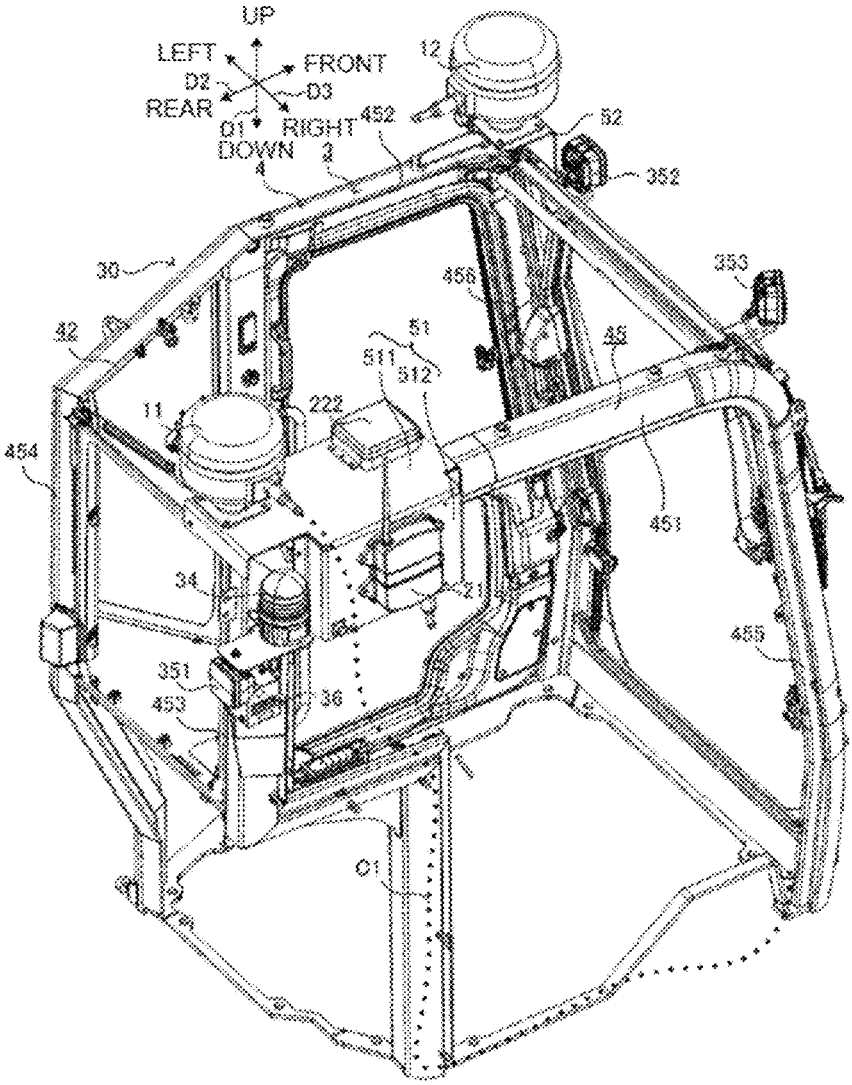
FIG. 12 is a schematic plan view of the occupant unit of the work machine according to Embodiment 1 as viewed obliquely from above in which panels of a cabin are omitted.
Figure 13:
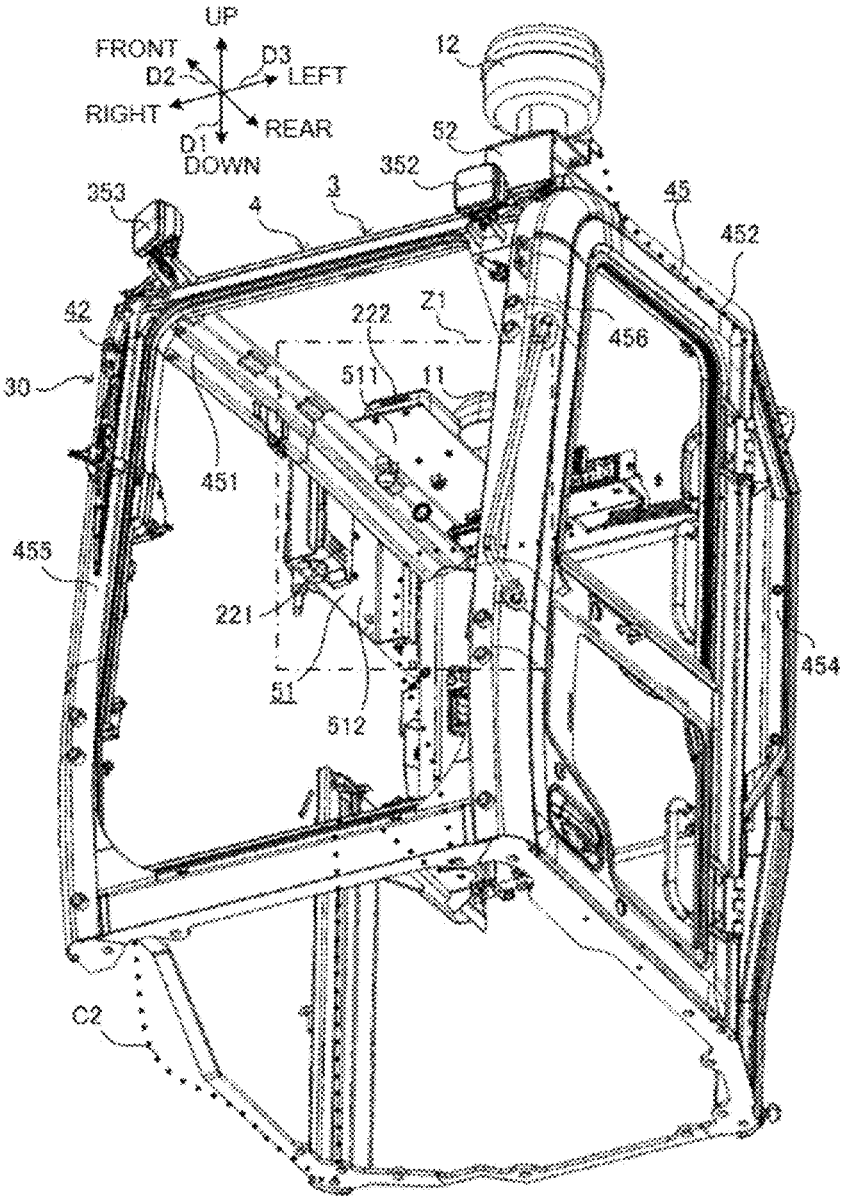
FIG. 13 is a schematic plan view of the occupant unit of the work machine according to Embodiment 1 as viewed obliquely from below in which the panels of the cabin are omitted.
Figure 14:
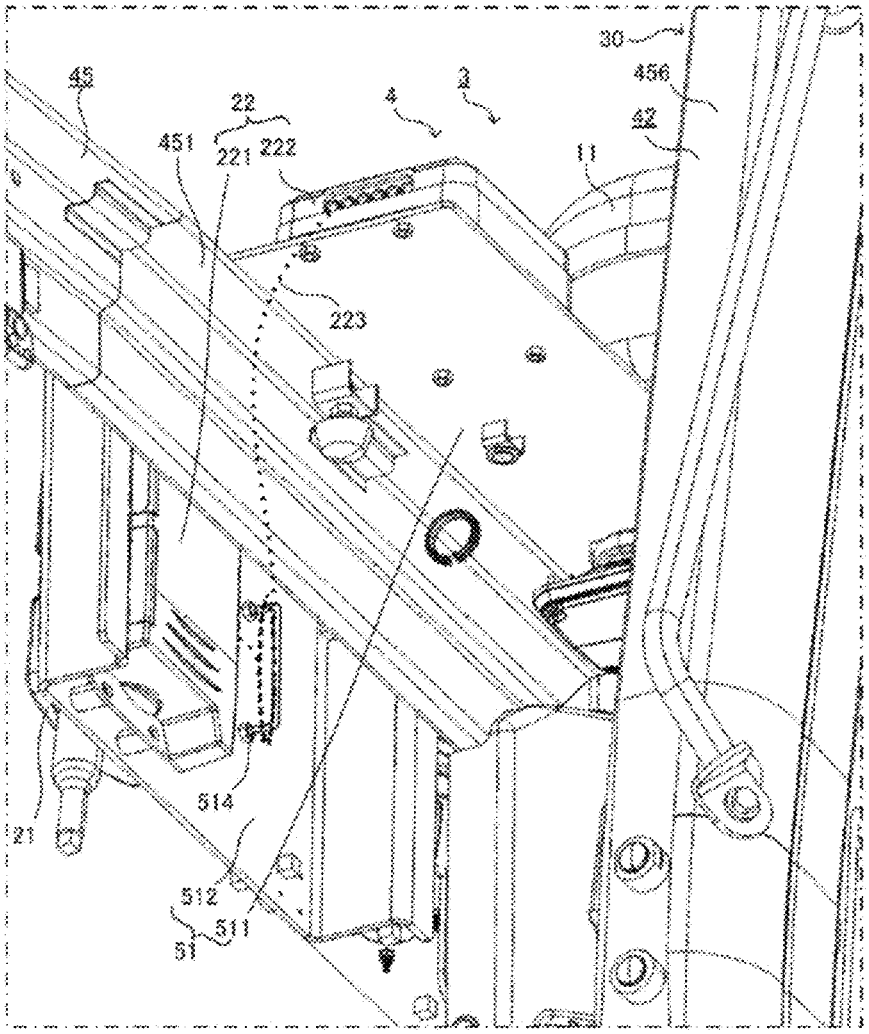
FIG. 14 is an enlarged view of the region Z1 in FIG. 13, and illustrates the main part of the occupant unit of the work machine according to Embodiment 1.

FIG. 5 is a perspective view of the occupant unit 4 as viewed obliquely from above, and FIG. 6 is an enlarged view of a region Z1 in FIG. 5. FIG. 7 is a right side view of the occupant unit 4, and FIG. 8 is an enlarged view of the region Z1 in FIG. 7. FIG. 9 is a front (front surface) view of the occupant unit 4, FIG. 10 is a rear (rear surface) view of the occupant unit 4, and FIG. 11 is a plan (top) view of the occupant unit 4. FIG. 12 is a perspective view of the occupant unit 4 as viewed obliquely from above in which the panels (the front panel 421, the left side panel 422, the right side panel 423, and the rear panel 424) of the cabin 42 are omitted. FIG. 13 is a perspective view of the occupant unit 4 as viewed obliquely from below in which the panels (the front panel 421, the left side panel 422, the right side panel 423, and the rear panel 424) of the cabin 42 are omitted, and FIG. 14 is an enlarged view of the region Z1 in FIG. 13. In these figures, the occupant seat, the operation device, the display device, and the like inside the cabin 42 are omitted as appropriate.

As described above, the work machine 3 according to the present embodiment includes the machine body 30 including the occupant unit 4 capable of accommodating an occupant, the first antenna 11, the second antenna 12, the first bracket 51, and the second bracket 52. The first antenna 11 and the second antenna 12 are disposed on the occupant unit 4 to be separated from each other in plan view. The first bracket 51 is supported by the occupant unit 4, and supports the first antenna 11. The second bracket 52 is provided separately from the first bracket 51, is supported by the occupant unit 4, and supports the second antenna 12.

That is, as illustrated in FIGS. 5 to 8, the first antenna 11 is supported by the first bracket 51 to be disposed above the occupant unit 4. The second antenna 12 is supported by the second bracket 52 to be disposed above the occupant unit 4. The first bracket 51 and the second bracket 52 are provided separately from each other, and are each individually supported by the occupant unit 4. Thus, the use of the first bracket 51 and the second bracket 52 allows the first antenna 11 and the second antenna 12 to be disposed above the occupant unit 4 while the first antenna 11 and the second antenna 12 are separated from each other in plan view.

The first bracket 51 to which the first antenna 11 is attached and the second bracket 52 to which the second antenna 12 is attached are provided separately from each other and achieve a small-sized mounting structure for the antennas (the first antenna 11 and the second antenna 12), easily allowing the work machine 3 to be light in weight and small in size. Consequently, it is possible to achieve an improved mounting structure for the antennas (the first antenna 11 and the second antenna 12).

The work machine 3 according to the present embodiment includes the machine body 30 including the occupant unit 4 capable of accommodating an occupant, the first antenna 11, and the first communication device 21. The first antenna 11 is disposed on the occupant unit 4. The first communication device 21 is disposed on one side of the occupant unit 4 in the width direction (left-right direction D3). In the present embodiment, as an example, the first communication device 21 is disposed on the right side of the occupant unit 4 in the width direction (left-right direction D3).

That is, as illustrated in FIGS. 5 to 8, the first antenna 11 is disposed above the occupant unit 4, and the first communication device 21 is disposed on one side of the occupant unit 4 in the width direction (left-right direction D3). In the present embodiment, in particular, the occupant unit 4 includes the cabin 42, and thus the first antenna 11 is located above the cabin roof 426 constituting an upper surface of the cabin 42, and the first communication device 21 is located on a lateral side (right side) of the cabin 42.

Such a positional relationship between the first antenna 11 and the first communication device 21 achieves an arrangement in which the first antenna 11 and the first communication device 21 are less likely to interfere with each other while the communication device (first communication device 21) is mounted around the cabin 42. Consequently, it is possible to efficiently attach the antenna (first antenna 11) and the communication device (first communication device 21).

More specifically, in the present embodiment, the first antenna 11 and the second antenna 12 both have a substantially disk shape that is a circular shape in plan view. The first antenna 11 and the second antenna 12 have the same outer shape.

As illustrated in FIGS. 5 to 10, in the present embodiment, the first antenna 11 and the second antenna 12 are located on a diagonal line of the occupant unit 4 in plan view. This makes it possible to ensure as much as possible the distance between the first antenna 11 and the second antenna 12. As a result, the first antenna 11 and the second antenna 12 are less likely to interfere with each other, enabling the antennas (the first antenna 11 and the second antenna 12) to receive a signal (such as a GNSS signal) with higher accuracy.

More specifically, the first antenna 11 and the second antenna 12 are located at a pair of corner portions that are opposite corners of the occupant unit 4 in plan view. In the present embodiment, the first antenna 11 is disposed at a right rear corner portion of the cabin roof 426 constituting the upper surface of the cabin 42 of the occupant unit 4, and the second antenna 12 is disposed at a left front corner portion of the cabin roof 426. This makes it possible to ensure as much as possible the distance between the first antenna 11 and the second antenna 12. As a result, the first antenna 11 and the second antenna 12 are less likely to interfere with each other, enabling the antennas (the first antenna 11 and the second antenna 12) to receive a signal (such as a GNSS signal) with higher accuracy.

In particular, in the present embodiment, the occupant unit 4 is disposed closer to one side of the machine body 30 in the width direction (left-right direction D3). In plan view, the second antenna 12 is located at the corner portion of the occupant unit 4 on the one side in the width direction (left-right direction D3), and the first antenna 11 is located at the corner portion of the occupant unit 4 on the other side. Specifically, the occupant unit 4 is disposed closer to the left side of the machine body 30 in the width direction (left-right direction D3). Therefore, the second antenna 12 is disposed at the corner portion of (the cabin 42) of the occupant unit 4 on the left side, that is, on the outer side of the machine body 30 in the width direction, and the first antenna 11 is disposed at the corner portion of (the cabin 42) of the occupant unit 4 on the right side, that is, on the inner side of the machine body 30 in the width direction.

Thus, at least the second antenna 12 can be disposed at a position closer to the outer side of the machine body 30 in the width direction, and the first antenna 11 can be disposed at a position closer to the center of the machine body 30 in the width direction. This makes it possible to ensure as much as possible the distance between the first antenna 11 and the second antenna 12, and the first antenna 11 and the second antenna 12 are less likely to interfere with each other, enabling the antennas (the first antenna 11 and the second antenna 12) to receive a signal (such as a GNSS signal) with higher accuracy.

Furthermore, in the present embodiment, the occupant unit 4 is disposed closer to one side of the machine body 30 in the width direction (left-right direction D3), and the machine body 30 includes a hood 322 (see FIG. 4) on the other side of the machine body 30 in the width direction (left-right direction D3). Specifically, the occupant unit 4 is disposed closer to the left side of the machine body 30 in the width direction (left-right direction D3); thus, the hood 322 is provided to be openable and closeable on a right end portion of an upper surface of the turning unit 32. From an inspection opening closed by the hood 322, it is possible to perform maintenance (fuel supply or the like) of the fuel tank, the hydraulic oil tank, the cooling water tank, and the like while the hood 322 is opened. In the present embodiment, the hood 322 is rotated using a rear end portion of the hood 322 as a fulcrum to be opened and closed.

The work implement 33 is interposed between the occupant unit 4 and the hood 322 in the left-right direction D3. Thus, the first antenna 11, the second antenna 12, and the like attached to the occupant unit 4 do not interfere with the hood 322. Naturally, even when the hood 322 is opened by being rotated using the rear end portion of the hood 322 as a fulcrum, the hood 322 is not in contact with the first antenna 11, the second antenna 12, or the like.

As illustrated in FIG. 6, the first communication device 21 includes a device body 211 and an antenna 212. In the present embodiment, as an example, the first communication device 21 is a communication device that performs mobile communication, and thus the antenna 212 is a stick-type (rod-type) antenna that protrudes upward from the device body 211.

As illustrated in FIG. 6, the second communication device 22 includes a device body 221 and an antenna 222. In the present embodiment, as an example, the second communication device 22 is a communication device that performs wireless communication in accordance with Wi-Fi (registered trademark), and thus the antenna 222 is provided separately from the device body 221, and is electrically connected to the device body 221 by a cable 223 (see FIG. 14).

The first communication device 21 is supported, together with the first antenna 11, by the first bracket 51. That is, the work machine 3 according to the present embodiment includes the first bracket 51 that is supported by the occupant unit 4 and supports the first antenna 11. The first communication device 21 is supported by the first bracket 51. Thus, the first bracket 51 for attaching the first antenna 11 can also be used to attach the first communication device 21.

The first communication device 21 is supported, together with the first antenna 11, by the first bracket 51; thus, the first antenna 11 and the first communication device 21 are located at the same corner portion of the occupant unit 4 in plan view. In the present embodiment, the first antenna 11 and the first communication device 21 are located at the right rear corner portion of the cabin roof 426 constituting the upper surface of the cabin 42 of the occupant unit 4. Thus, the first antenna 11 and the first communication device 21 are disposed at the same corner portion (right rear corner portion in this case) of the occupant unit 4, enabling the first antenna 11 and the first communication device 21 to be efficiently arranged.

As illustrated in FIGS. 7 to 10, the first communication device 21 is located below the first antenna 11. In other words, the first communication device 21 is disposed at a position lower than the first antenna 11 in the up-down direction D1. Specifically, at least the device body 211 of the first communication device 21 is located at a position lower than the first antenna 11. A lower end of the device body 211 of the first communication device 21 is located below a lower end of the first antenna 11. Furthermore, in the present embodiment, an upper end of the device body 211 of the first communication device 21 is also located below the lower end of the first antenna 11.

That is, the first communication device 21 is disposed at a position shifted downward from the first antenna 11. Thus, the first antenna 11 and the first communication device 21 are disposed to be shifted from each other in front view or side view, easily avoiding interference between the first antenna 11 and the first communication device 21.

As illustrated in FIGS. 7 to 10, the first antenna 11 and the second antenna 12 are located at the same height. In other words, the first antenna 11 and the second antenna 12 are disposed at the same position in the up-down direction D1. Specifically, at least part of the second antenna 12 in the up-down direction D1 is located within the width of the first antenna 11 in the up-down direction D1, and at least part of the first antenna 11 in the up-down direction D1 is located within the width of the second antenna 12 in the up-down direction D1. That is, the first antenna 11 and the second antenna 12 can be considered to be located at the same height when at least part of the first antenna 11 and at least part of the second antenna 12 are located at the same height. In the present embodiment, a center of the first antenna 11 in the up-down direction D1 and a center of the second antenna 12 in the up-down direction D1 are located at the same height.

That is, the first antenna 11 and the second antenna 12 located at the same height allow the work machine 3 to have a smaller overall height while the first antenna 11 and the second antenna 12 are disposed at a position as high as possible. Consequently, for example, during transport of the work machine 3, the work machine 3 has a smaller overall height even when the first antenna 11 and the second antenna 12 are attached to the work machine 3, enabling easy transport of the work machine 3.

The first communication device 21 is located in front of the first antenna 11. Specifically, as illustrated in FIG. 8, the first communication device 21 is located in front of the first antenna 11 in the front-rear direction D2. In this case, a front end of the first communication device 21 is located in front of a front end of the first antenna 11. Furthermore, in the present embodiment, a rear end of the first communication device 21 is also located in front of the front end of the first antenna 11.

That is, the first antenna 11 is disposed at a position shifted rearward from the first communication device 21. Thus, the first antenna 11 and the first communication device 21 are disposed to be shifted from each other in plan view, easily avoiding interference between the first antenna 11 and the first communication device 21.

Furthermore, in the present embodiment, as illustrated in FIG. 6, the first bracket 51 includes a first support portion 511 and a second support portion 512. The first support portion 511 supports the first antenna 11, and faces the upper surface of the occupant unit 4. The second support portion 512 supports the first communication device 21, and faces a side surface (right side surface) of the occupant unit 4 on one side (right side). That is, the first support portion 511 of the first bracket 51 that supports the first antenna 11 faces the cabin roof 426 constituting the upper surface of the cabin 42. The second support portion 512 of the first bracket 51 that supports the first communication device 21 faces the right side panel 423 constituting the right side surface of the cabin 42.

Thus, the first antenna 11 and the first communication device 21 can be attached to the occupant unit 4 (cabin 42) using a single first bracket 51 while avoiding interference between the first antenna 11 and the first communication device 21. Furthermore, in the present embodiment, the occupant unit 4 is disposed closer to the left side of the machine body 30 in the width direction (left-right direction D3); thus, when the first communication device 21 is attached to the right side surface of (the cabin 42 of) the occupant unit 4, the first communication device 21 is disposed on the inner side of the machine body 30 in the width direction with respect to the cabin 42. Therefore, as compared with the case where the first communication device 21 is attached to the outer side (left side) of the machine body 30 in the width direction with respect to the cabin 42, foreign matter is less likely to be in contact with the first communication device 21, leading to protection of the first communication device 21.

More specifically, the first bracket 51 is composed of a metal plate, and includes the first support portion 511 that extends along a horizontal plane (the upper surface of the cabin 42), and the second support portion 512 that extends along a vertical plane (the right side surface of the cabin 42). The second support portion 512 protrudes downward from a right end edge of the first support portion 511, and the first bracket 51 including the first support portion 511 and the second support portion 512 as a whole has a substantially L-shape in front view.

The first bracket 51 having such a configuration is detachably fixed to the cabin 42 of the occupant unit 4 using a fastener such as a bolt and/or a nut. The first antenna 11 is attached to an upper surface of the first support portion 511 (a surface of the first support portion 511 on the side opposite to the cabin 42) of the first bracket 51. The first communication device 21 is attached to a right side surface of the second support portion 512 (a surface of the second support portion 512 on the side opposite to the cabin 42) of the first bracket 51. Thus, the first bracket 51 can support each of the first antenna 11 and the first communication device 21 while the first antenna 11 and the first communication device 21 are not in contact with (are located at a position apart from) the cabin 42.

The second bracket 52 is composed of a metal plate, and has a first portion that extends along a horizontal plane (the upper surface of the cabin 42), and a second portion that protrudes downward from a front end edge of the first portion and extends along a vertical plane (the front surface of the cabin 42). Thus, as illustrated in FIGS. 5 and 7, the second bracket 52 as a whole has a substantially L-shape in side view.

The second bracket 52 having such a configuration is detachably fixed to the cabin 42 of the occupant unit 4 using a fastener such as a bolt and/or a nut. The second antenna 12 is attached to an upper surface of the second bracket 52 (a surface of the second bracket 52 on the side opposite to the cabin 42). Thus, the second bracket 52 can support the second antenna 12 while the second antenna 12 is not in contact with (is located at a position apart from) the cabin 42.

Furthermore, as illustrated in FIGS. 6 and 8, the device body 221 of the second communication device 22 is attached to a left side surface of the second support portion 512 (a surface of the second support portion 512 on the cabin 42 side) of the first bracket 51. That is, the first communication device 21 and (the device body 221 of) the second communication device 22 are attached to the second support portion 512 of the first bracket 51. The first communication device 21 and (the device body 221 of) the second communication device 22 are respectively attached to the front surface and back surface of the second support portion 512.

In short, the work machine 3 according to the present embodiment includes an electrical component that is attached to a surface of the second support portion 512 that faces the side surface (right side surface) of the occupant unit 4 on one side (right side). In the present embodiment, (the device body 221 of) the second communication device 22 is an example of the electrical component. That is, (the device body 221 of) the second communication device 22 as an electrical component is disposed between the second support portion 512 of the first bracket 51 and the side surface (right side surface) of the cabin 42. Thus, a gap between the first bracket 51 and the cabin 42 can be effectively used, and (the device body 221 of) the second communication device 22 is not exposed to the outside, leading to protection of the second communication device 22.

As illustrated in FIGS. 6 and 8, the antenna 222 of the second communication device 22 is attached to the upper surface of the first support portion 511 (the surface of the first support portion 511 on the side opposite to the cabin 42) of the first bracket 51. That is, the first antenna 11 and the antenna 222 of the second communication device 22 are attached to the first support portion 511 of the first bracket 51. The antenna 222 of the second communication device 22 is disposed in front of the first antenna 11 so that the first antenna 11 and the antenna 222 are arranged in the front-rear direction D2.

That is, the antenna 222 of the second communication device 22 is located at a position in front of the first antenna 11 on the occupant unit 4 (cabin 42). An upper end of the antenna 222 of the second communication device 22 is located at a position lower than an upper end of the first antenna 11. Thus, a space above the cabin 42 can be effectively used, and the antenna 222 of the second communication device 22 does not protrude above the first antenna 11, allowing the work machine 3 to have a smaller overall height.

In the present embodiment, as illustrated in FIGS. 5 to 10, the indicator light 34, the light 351, and the alarm device 36 are disposed at the right rear corner portion of the cabin 42, as with the first antenna 11. The light 351 emits light toward the rear of the cabin 42. The indicator light 34, the light 351, and the alarm device 36 are arranged in this order from top in the up-down direction D1. The indicator light 34, the light 351, and the alarm device 36 are attached to the cabin 42 to protrude toward one lateral side (right side in the present embodiment) of the cabin 42 in the width direction (left-right direction D3) so that an upper end of the indicator light 34 is located at substantially the same height as an upper surface of the cabin roof 426.

The indicator light 34, the light 351, and the alarm device 36 are each fixed to the frame 45 constituting the cabin 42 of the occupant unit 4 using a mounting stay. More specifically, the indicator light 34, the light 351, and the alarm device 36 are attached to a vertical frame 453 (described below) of the frame 45 that is located at the right rear corner portion of the cabin 42.

The lights 352 and 353 emit light toward the front of the cabin 42. In the present embodiment, the light 352 is disposed at the left front corner portion of the cabin 42, as with the second antenna 12. The light 353 is disposed at a right front corner portion of the cabin 42. The lights 352 and 353 are disposed to be shifted from each other in the up-down direction D1 so that the light 353 is located at a position higher than the light 352. The lights 352 and 353 are attached to the cabin 42 to protrude toward the front of the cabin 42 so that an upper end of the light 353 is located at substantially the same height as the upper surface of the cabin roof 426.

The first bracket 51 has a recessed portion 513 in a rear end portion of the second support portion 512. As illustrated in FIGS. 6 and 8, the recessed portion 513 is formed using the second support portion 512 having a shorter length than the first support portion 511 in the front-rear direction D2 and having a rear portion that is cut out. The indicator light 34 disposed in the recessed portion 513 formed in this manner makes it possible to avoid interference between the indicator light 34 and the first bracket 51.

With the positional relationship described above, as illustrated in FIG. 11, the indicator light 34 is adjacent to the first antenna 11 in the width direction (left-right direction D3) of the machine body 30 in plan view. That is, the indicator light 34 is disposed adjacent to the first antenna 11 on the right side of the first antenna 11 in the left-right direction D3. Thus, the first antenna 11 and the indicator light 34 are less likely to interfere with each other, ensuring the visibility of the indicator light 34.

The alarm device 36 is located behind the first communication device 21. That is, in the front-rear direction D2, the alarm device 36 located below the indicator light 34 is disposed behind the first communication device 21 attached to the first bracket 51. Thus, the first communication device 21 and the alarm device 36 are less likely to interfere with each other, and it is possible to allow the amount of protrusion of the alarm device 36 from the cabin 42 in the width direction (left-right direction D3) of the machine body 30 to be small.

Furthermore, the first communication device 21 is located in front of and above the light 351 for illuminating the rear of the cabin 42. That is, the first communication device 21 is disposed at a position that is in front of the light 351 in the front-rear direction D2 and is higher than the light 351 in the up-down direction D1. Thus, the first communication device 21 and the light 351 are less likely to interfere with each other, securing a region irradiated with light from the light 351.

As illustrated in FIG. 11, the light 352 is adjacent to the second antenna 12 in the front-rear direction D2 of the machine body 30 in plan view. That is, the light 352 for illuminating the front of the cabin 42 is disposed adjacent to the second antenna 12 in front of the second antenna 12 in the front-rear direction D2. Thus, the second antenna 12 and the light 352 are less likely to interfere with each other, securing a region irradiated with light from the light 352.

As illustrated in FIG. 11, the first antenna 11 overlaps with a rear end portion of the occupant unit 4 in plan view. Specifically, a rear end of the cabin roof 426 constituting the upper surface of the cabin 42 of the occupant unit 4 is located within the width of the first antenna 11 in the front-rear direction D2. In other words, the front end of the first antenna 11 is located in front of the rear end of the cabin roof 426, and a rear end of the first antenna 11 is located behind the rear end of the cabin roof 426.

That is, the first antenna 11 is disposed at a position that is located above the cabin 42 of the occupant unit 4 and is as close to the rear as possible. With this configuration, the first antenna 11 is less likely to be influenced by the occupant unit 4 (cabin 42), enabling the first antenna 11 to receive a signal (such as a GNSS signal) with higher accuracy.

The second antenna 12 overlaps with or is in contact with an outer peripheral edge of the occupant unit 4 in plan view. Specifically, a rear end of the cabin roof 426 constituting the upper surface of the cabin 42 of the occupant unit 4 is located within the width of the first antenna 11 in the front-rear direction D2. In other words, the front end of the first antenna 11 is located in front of the rear end of the cabin roof 426, and a rear end of the first antenna 11 is located behind the rear end of the cabin roof 426.

That is, the first antenna 11 is disposed at a position that is located above the cabin 42 of the occupant unit 4 and is as close to the rear as possible. With this configuration, the first antenna 11 is less likely to be influenced by the occupant unit 4 (cabin 42), enabling the first antenna 11 to receive a signal (such as a GNSS signal) with higher accuracy.

As illustrated in FIGS. 12 and 13, the frame 45 constituting the cabin 42 of the occupant unit 4 includes a pair of roof frames 451 and 452 and vertical frames 453 to 456.

The pair of roof frames 451 and 452 are frame members that are located in both end portions of the cabin roof 426 in the width direction (left-right direction D3) and are long in the front-rear direction D2. Specifically, the roof frame 451 is located in a right end portion of the cabin roof 426, and the roof frame 452 is located in a left end portion of the cabin roof 426.

The vertical frames 453 to 456 are frame members that are located at four corners (four corner portions) of the cabin roof 426 and are long in the up-down direction D1. Specifically, the vertical frame 453 is located at a right rear corner portion of the cabin roof 426, the vertical frame 454 is located at a left rear corner portion of the cabin roof 426, the vertical frame 455 is located at a right front corner portion of the cabin roof 426, and the vertical frame 456 is located at a left front corner portion of the cabin roof 426.

Thus, in the present embodiment, the occupant unit 4 includes the pair of frames (roof frames 451 and 452) on both sides of the machine body 30 in the width direction (left-right direction D3). The second antenna 12 overlaps with one of the pair of frames (roof frames 451 and 452) in plan view. Specifically, as illustrated in FIG. 11, the second antenna 12 overlaps with the roof frame 452 on the left side of the pair of roof frames 451 and 452. With this configuration, the second antenna 12 is less likely to interfere with another electrical component. Similarly, the first antenna 11 overlaps with the roof frame 451 on the right side of the pair of roof frames 451 and 452, and thus the first antenna 11 is also less likely to interfere with another electrical component.

Furthermore, in plan view, the second support portion 512 is disposed to be shifted to the front side from the vertical frame 453 located at a corner portion of the occupant unit 4. Specifically, as illustrated in FIG. 8, the second support portion 512 is disposed to be shifted to the front side in the front-rear direction D2 from the vertical frame 453 of the vertical frames 453 to 456 that is located at the right rear corner portion of the cabin 42. Thus, the second support portion 512 of the first bracket 51 can be disposed so that the second support portion 512 does not interfere with the indicator light 34 or the like attached to the vertical frame 453 and the amount of protrusion of the second support portion 512 from the cabin 42 toward the lateral side (right side) is as small as possible.

Next, a routing path of cables (first cable C1 and second cable C2) electrically connected to the first antenna 11 and the second antenna 12 will be described with reference to FIGS. 12 and 13. In FIG. 12, a path on which the first cable C1 is routed is indicated by a dotted line, and in FIG. 13, a path on which the second cable C2 is routed is indicated by a dotted line. The first cable C1 and the second cable C2 are appropriately supported by the cabin 42 using a cable clamp or the like.

As illustrated in FIG. 12, the first cable C1 electrically connected to the first antenna 11 is routed along the surface of the second support portion 512 of the first bracket 51 on the side opposite to the occupant unit 4. That is, the first cable C1 is drawn rightward from the first antenna 11 and routed downward along the surface (right side surface) of the second support portion 512 of the first bracket 51 on the side opposite to the cabin 42. Thus, the second support portion 512 functions as a shield, and a noise is less likely to occur in the first cable C1.

As illustrated in FIG. 13, the (second) cable C2 electrically connected to the second antenna 12 extends in the width direction (left-right direction D3) of the machine body 30. That is, the second cable C2 has at least a portion extending in the left-right direction D3. Specifically, the second cable C2 is drawn rearward from the second antenna 12 disposed at the left front corner portion of the cabin 42 and routed along the roof frame 452, and is further routed in the left-right direction D3 from a rear end portion of the roof frame 452 toward the first bracket 51. Thus, the second cable C2 connected to the second antenna 12 disposed at the left front corner portion of the cabin 42 can be routed to the right side of the cabin 42.

In addition, the (second) cable C2 is routed below the first antenna 11. That is, the second cable C2 is routed in the left-right direction D3 along a rear end edge of the cabin roof 426, and thus is routed to pass through a position below the first antenna 11 located above the rear end edge of the cabin roof 426. This makes it possible to avoid influence of the second cable C2 on the first antenna 11.

The second cable C2 is routed between the first bracket 51 and the cabin 42. Specifically, the second cable C2 is routed between the upper surface of the cabin 42 and the first support portion 511 and between the second support portion 512 and the right side surface of the cabin 42.

Thus, in the present embodiment, the work machine 3 includes the second antenna 12 that is disposed on the occupant unit 4 to be separated from the first antenna 11 in plan view, and the second cable C2 that is electrically connected to the second antenna 12. The second cable C2 is routed between the upper surface of the occupant unit 4 and the first support portion 511 and between the second support portion 512 and the side surface (right side surface) of the occupant unit 4 on one side. Thus, the second support portion 512 functions as a shield, and a noise is less likely to occur in the second cable C2.

As illustrated in FIG. 14, in the second communication device 22, the cable 223 (indicated by a dotted line in FIG. 14) that electrically connects the device body 221 to the antenna 222 passes through a space between the second support portion 512 of the first bracket 51 and the cabin 42, and is connected to the device body 221. The cable 223 has a sufficient excess length for the distance between the device body 221 and the antenna 222. Thus, an excess portion of the cable 223 is tied in a bundle and fixed, using a tying means such as a tying band, for example, to a mounting portion 514 such as a round steel fixed to the back surface (left side surface) of the second support portion 512 by a joining means such as welding.

[3] Modifications

Modifications of Embodiment 1 will be listed below. The modifications described below can be applied in combination as appropriate.

The occupant unit 4 is not limited to the cabin type, and may be, for example, of the canopy type, the floor type, or the like. The canopy type or floor type occupant unit 4 does not include the door 43, but includes an entrance through which an occupant gets in and out of the occupant unit 4. For example, the floor type occupant unit 4 includes no structure on the upper side of the entrance, and thus the entrance is opened upward.

The configuration of the entrance such as the door 43 is not limited to the configuration in which the entrance is disposed on the left (left side) of the occupant unit 4 as in Embodiment 1. That is, the entrance through which an occupant gets in and out of the occupant unit 4 only needs to be disposed at least on one side of the occupant unit 4 in the left-right direction D3, and may be disposed, for example, on the right (right side) of the occupant unit 4 or on both sides of the occupant unit 4 in the left-right direction D3.

It is not essential for the work machine 3 to be of the "ultra-small turning type" or the "rear ultra-small turning type".

At least one of the second antenna 12, the first communication device 21, the second communication device 22, the indicator light 34, the lights 351, 352, and 353, and the alarm device 36 can be omitted as appropriate.

The power source of the work machine 3 is not limited to a diesel engine, and may be, for example, an engine other than a diesel engine, a motor (electric motor), or a hybrid power source including an engine and a motor (electric motor).

APPENDICES OF THE INVENTION

The overview of the invention extracted from the above-described embodiment will be appended. The configurations and processing functions described in the following appendices can be selected and arbitrarily combined.

Appendix 1

A work machine including:

a machine body that includes an occupant unit capable of accommodating an occupant;

a first antenna and a second antenna that are disposed on the occupant unit to be separated from each other in plan view;

a first bracket that is supported by the occupant unit and supports the first antenna; and a second bracket that is provided separately from the first bracket, is supported by the occupant unit, and supports the second antenna.

Appendix 2

The work machine according to appendix 1, wherein the first antenna overlaps with a rear end portion of the occupant unit in plan view.

Appendix 3

The work machine according to appendix 1 or 2, wherein the second antenna overlaps with or is in contact with an outer peripheral edge of the occupant unit in plan view.

Appendix 4

The work machine according to any one of appendices 1 to 3, wherein the first antenna and the second antenna are located at a same height.

Appendix 5

The work machine according to any one of appendices 1 to 4, wherein the first antenna and the second antenna are located at a pair of corner portions that are opposite corners of the occupant unit in plan view.

Appendix 6

The work machine according to any one of appendices 1 to 5, wherein the occupant unit is disposed closer to one side of the machine body in a width direction, and in plan view, the second antenna is located at a corner portion of the occupant unit on the one side in the width direction, and the first antenna is located at a corner portion of the occupant unit on another side of the machine body in the width direction.

Appendix 7

The work machine according to any one of appendices 1 to 6, further including an indicator light that is adjacent to the first antenna in a width direction of the machine body in plan view.

Appendix 8

The work machine according to any one of appendices 1 to 7, wherein the occupant unit includes a pair of frames on both sides of the machine body in a width direction, and the second antenna overlaps with one of the pair of frames in plan view.

Appendix 9

The work machine according to any one of appendices 1 to 8, further including a light that is adjacent to the second antenna in a front-rear direction of the machine body in plan view.

Appendix 10

The work machine according to any one of appendices 1 to 9, wherein the first antenna and the second antenna are located on a diagonal line of the occupant unit in plan view.

Appendix 11

The work machine according to any one of appendices 1 to 10, further including a cable that is electrically connected to the second antenna and extends in a width direction of the machine body.

Appendix 12

The work machine according to appendix 11, wherein the cable is routed below the first antenna.

Appendix 13

The work machine according to any one of appendices 1 to 12, wherein the occupant unit is disposed closer to one side of the machine body in a width direction, and the machine body includes a hood on another side of the machine body in the width direction.

Appendix 14

A work machine including:

a machine body that includes an occupant unit capable of accommodating an occupant; and a first antenna that is disposed on the occupant unit, wherein the first antenna overlaps with a rear end portion of the occupant unit in plan view.

Appendix 15 a machine body that includes an occupant unit capable of accommodating an occupant; and a second antenna that is disposed on the occupant unit, wherein the second antenna overlaps with or is in contact with an outer peripheral edge of the occupant unit in plan view.

REFERENCE SIGNS LIST

3 Work machine
4 Occupant unit
11 First antenna
12 Second antenna
30 Machine body
34 Indicator light
51 First bracket
52 Second bracket
322 Hood
352 Light
451, 452 Roof frame (frame)
C2 (Second) cable
D3 Left-right direction (width direction)

The invention claimed is:

1. A work machine comprising:

a machine body that includes an occupant unit capable of accommodating an occupant;

a first antenna and a second antenna configured to identify a position of the machine body, disposed on the occupant unit to be separated from each other in plan view, and located at corner portions of the occupant unit that are diagonally opposite in plan view;

a first bracket that is supported by the occupant unit and supports the first antenna; and a second bracket that is provided separately from the first bracket, is supported by the occupant unit, and supports the second antenna.

2. The work machine according to claim 1, wherein the first antenna overlaps with a rear end portion of the occupant unit in plan view.

3. The work machine according to claim 1, wherein the second antenna overlaps with or is in contact with an outer peripheral edge of the occupant unit in plan view.

4. The work machine according to claim 1, wherein the first antenna and the second antenna are located at a same height.

5. The work machine according to claim 1, wherein the first antenna and the second antenna are located at a pair of corner portions that are opposite corners of the occupant unit in plan view.

6. The work machine according to claim 1, wherein the occupant unit is disposed closer to one side of the machine body in a width direction, and in plan view, the second antenna is located at a corner portion of the occupant unit on the one side in the width direction, and the first antenna is located at a corner portion of the occupant unit on another side of the machine body in the width direction.

7. The work machine according to claim 1, further comprising an indicator light that is adjacent to the first antenna in a width direction of the machine body in plan view.

8. The work machine according to claim 1, wherein the occupant unit includes a pair of frames on both sides of the machine body in a width direction, and the second antenna overlaps with one of the pair of frames in plan view.

9. The work machine according to claim 1, further comprising a light that is adjacent to the second antenna in a front-rear direction of the machine body in plan view.

10. The work machine according to claim 1, wherein the first antenna and the second antenna are located on a diagonal line of the occupant unit in plan view.

11. The work machine according to claim 1, further comprising a cable that is electrically connected to the second antenna and extends in a width direction of the machine body.

12. The work machine according to claim 11, wherein the cable is routed below the first antenna.

13. The work machine according to claim 1, wherein the occupant unit is disposed closer to one side of the machine body in a width direction, and the machine body includes a hood on another side of the machine body in the width direction.

14. The work machine according to claim 1, wherein the first antenna and the second antenna are coplanar.

15. The work machine according to claim 1, wherein both the first antenna and the second antenna are GNSS antennas.

* * * * *